US008047477B2

(12) United States Patent
Wilkinson

(10) Patent No.: US 8,047,477 B2
(45) Date of Patent: Nov. 1, 2011

(54) DEVICE TO FACILITATE FILLING A REUSABLE BAG, A CONVENTIONAL TRASH BAG OR A RECEPTACLE

(76) Inventor: Thomas F. Wilkinson, Albuquerque, NM (US)

( * ) Notice: Subject to any disclaimer, the term of this patent is extended or adjusted under 35 U.S.C. 154(b) by 355 days.

(21) Appl. No.: 12/367,789

(22) Filed: Feb. 9, 2009

(65) Prior Publication Data

US 2010/0200709 A1 Aug. 12, 2010

(51) Int. Cl.
*B65B 67/04* (2006.01)

(52) U.S. Cl. ..... 248/99; 248/94

(58) Field of Classification Search ..... 248/94, 248/95, 99, 907, 100; 294/1.1; 220/495.08, 220/495.06, 495.01, FOR. 116, FOR. 115
See application file for complete search history.

(56) References Cited

U.S. PATENT DOCUMENTS

| | | | | | |
|---|---|---|---|---|---|
| 172,299 | A | * | 1/1876 | Cornell | 248/99 |
| 365,748 | A | * | 6/1887 | Jacoby | 248/94 |
| 918,355 | A | * | 4/1909 | McGowan | 248/94 |
| 2,524,243 | A | * | 10/1950 | Wicklund | 248/94 |
| 2,731,184 | A | | 1/1956 | Thurber | |
| 3,997,169 | A | | 12/1976 | Bergstrom | |
| D289,577 | S | | 4/1987 | Graham | |
| 4,671,708 | A | | 6/1987 | Hurd | |
| 4,776,478 | A | | 10/1988 | Miller et al. | |
| 4,832,292 | A | * | 5/1989 | Beckham | 248/99 |
| 5,090,756 | A | * | 2/1992 | Pfisterer | 294/1.1 |
| 5,116,138 | A | * | 5/1992 | Macsenti et al. | 383/33 |
| 5,498,046 | A | * | 3/1996 | Ridley et al. | 294/1.1 |
| 5,593,117 | A | | 1/1997 | Alexander, III | |
| 5,655,739 | A | * | 8/1997 | Teh-Wah Goo | 248/101 |
| D389,634 | S | | 1/1998 | Shope | |
| 5,785,369 | A | * | 7/1998 | Ridley et al. | 294/1.1 |
| 5,879,039 | A | | 3/1999 | Baker et al. | |
| 6,116,548 | A | | 9/2000 | Oleson | |
| 6,116,549 | A | | 9/2000 | Santa Cruz et al. | |
| 6,135,518 | A | * | 10/2000 | Holthaus | 294/1.1 |
| D440,729 | S | | 4/2001 | Piner et al. | |
| 6,450,461 | B1 | | 9/2002 | Lohmann | |
| 6,554,810 | B1 | | 4/2003 | Wilk et al. | |
| 6,708,742 | B2 | | 3/2004 | Weathers et al. | |
| D502,582 | S | | 3/2005 | Boles | |
| 6,938,860 | B2 | * | 9/2005 | Singleton | 248/99 |
| D513,352 | S | * | 12/2005 | Weathers et al. | D34/5 |
| 6,974,167 | B2 | | 12/2005 | Springs, II | |
| 7,066,432 | B2 | | 6/2006 | Wood et al. | |
| 7,281,690 | B2 | | 10/2007 | Kelley | |
| 7,302,904 | B2 | | 12/2007 | Burns | |

(Continued)

*Primary Examiner* — A. Joseph Wujciak, III
(74) *Attorney, Agent, or Firm* — Yorgos Marinakis

(57) ABSTRACT

A device to facilitate filling a reusable bag, a conventional trash bag or a receptacle. The device and bag or receptacle are used horizontally. The device comprises a funneled receiver, channel, stakes, and optionally four legs. The receiver is a scoop-like device having semi-frusto-conical cross-sections. The channel is a non-funneled extension of the receiver, having trapezoidal cross-sections. If a bag is used, the device facilitates filling the bag and it also holds open the bag. The optional four legs also hold open the body of the bag and, by contributing to the stability of the device, they allow the device to be smaller and lighter than otherwise. The device is normally placed on the ground, and inserted into either the bag or the receptacle. Leaves, grass clippings and other debris are raked or otherwise projected through the front of the receiver. The front of the receiver has a turned-over lip that facilitates filling the bag and that also acts as a handle.

20 Claims, 4 Drawing Sheets

U.S. PATENT DOCUMENTS

| | | | | |
|---|---|---|---|---|
| 7,302,978 | B1 | 12/2007 | Kolarik | |
| 7,815,153 | B2 * | 10/2010 | Campbell et al. | 248/99 |
| 2002/0100844 | A1 | 8/2002 | Green | |
| 2002/0100845 | A1 | 8/2002 | Green | |
| 2003/0173471 | A1 * | 9/2003 | Weathers et al. | 248/99 |
| 2003/0218104 | A1 | 11/2003 | Klotz | |
| 2004/0195468 | A1 * | 10/2004 | Singleton | 248/99 |
| 2005/0087657 | A1 | 4/2005 | Dran | |

* cited by examiner

DEVICE TO FACILITATE FILLING A REUSABLE BAG, A CONVENTIONAL TRASH BAG OR A RECEPTACLE

CROSS-REFERENCE TO RELATED APPLICATIONS

None.

STATEMENTS REGARDING FEDERALLY SPONSORED RESEARCH AND DEVELOPMENT

Not applicable.

BACKGROUND

The present invention satisfies the need of an improved device to facilitate fitting a reusable bag, a conventional trash bag or a receptacle.

Information relevant to attempts to address this problem can be found in U.S. Pat. Nos. 2,731,184; 3,997,169; 4,671,708; 5,593,117; 5,655,739; 5,879,039; 6,166,548; 6,116,549; 6,135,518; 6,450,461; 6,554,810; 6,708,742; 6,974,167; 7,066,432; 7,281,690; 7,302,904; 7,302,978; 4,776,478; D289,577; D389,634; D440,729; D502,582; D513,352; and U.S. Patent Application No.'s 20020100844; 20020100845; 20030173471; 20030218104; and 20050087657; which are not admitted to be prior art with respect to the present invention by its mention in this Background Section. However, it is desirable to have better apparatuses and/or methods than what is disclosed in the identified references. Relevant fields of art include 52/155; 141/391; 248/99, 146, 156; and D34/5, 6.

U.S. Pat. No. 5,593,117 is a lawn and garden debris collecting apparatus comprising a two-component funneled receiver and a bag. The front of the receiver has an funnel-shaped mouth with a tapering rectangular cross-section followed by a much shorter portion tapering in the reverse direction. All four sides of the funnel taper in three dimensions, in contrast to the present invention in which only three sides of the funnel taper in three dimensions and the fourth side tapers in two dimensions. The rear of the receiver has a non-tapering rectangular cross section. These front and the rear portions are separate from one another, and are connected only by a strap on both sides, in contrast to the present invention in which the receiver and channel are integrally formed. The receiver lies on the ground, but unlike the present invention it has no stake or anchor. It has a cut-out hand-hold, unlike the present invention which has a handhold integrally formed from the receiver front terminal edge.

U.S. Pat. No. 5,655,739 is a tubular receiver having a sigmoidal tapered front, a baseboard, and a rear locking ring for holding a bag in place.

U.S. Pat. No. 5,879,039 is an elongated tube with two handles on the sides. The device is made for vertical use, for fitting sandbags.

In contrast to U.S. Pat. Nos. 6,116,548 and 6,116,549, the legs of the present invention are not a support stand, in the sense that they do not support the receiver. The receiver lies on the ground. Two of the legs lie lengthwise on the ground.

U.S. Pat. No. 6,135,518 has a funneled receiver and channel. All four walls of the receiver taper away from the plane of the channel. The device is made for vertical use.

U.S. Pat. No. 6,450,461 is simply a hollow four-sided rectangular frame, with holes with longitudinal slits for receiving bolts connected to a bag to hold the bag.

U.S. Pat. No. 6,708,742 has a funneled receiver and channel with parallel sides, but only the channel has a top wall. The handle is attached onto the top wall of the channel. The device is made to insert into a custom receptacle. Optionally the channel is removable and the funnel placed into a bag; such as configuration has no handle. It has no stakes.

U.S. Pat. No. 6,974,167 has a receiver with parallel side walls and a funneled channel, the reverse of the present invention. It has no top wall or optional legs. It is not made to lie flush on the ground. It works only with receptacles, not with bags. It has a bracket for attaching to the mouth of the receptacle. It has no stakes.

SUMMARY

The embodiments of the present invention comprise an apparatus and a method for manufacturing that apparatus.

The apparatus comprises a funneled receiver, channel, a stake or stakes, and optionally four legs. A stake is a pointed piece of wood or other material driven or to be driven into the soil. I refer to the point of the stake as the tine. The tine is used here to puncture the soil and it facilitates subsequently pushing the stake into the soil.

The receiver is adapted to receive a bag on the exterior of the back end of the channel. It is also adapted to rest, along with the channel, in the mouth of a trash receptacle. In a preferred embodiment, the invention is sized to accommodate from 32 to 50 gallon bags. Such embodiment has channel dimensions of approximately 12 inches long, 14 inches high and 12 inches wide.

The receiver is shaped like a scoop. The receiver has a semi-frusto-conical shape, "semi-" in the sense that the bottom wall tapers only laterally and remains flush with the ground, "frusto-conical" in the sense that it is a frustum with a trapezoidal base, with rounded edges like a cone.

The front of the receiver is an inlet to the device, and the back of the channel is an outlet from the device into the bag.

The front terminal edges of the top and side walls of the receiver taper continuously in a sigmoidal shape. They also fold back, forming an integral handle. The fold also helps funnel the debris into the receiver.

The geometry of the device contributes to its stability. The receiver bottom wall front terminal edge length is longer than the receiver top wall front terminal edge. The receiver bottom wall back terminal edge length is longer than the receiver top wall back terminal edge. The receiver side wall front terminal edge length is longer than the receiver top wall front terminal edge but shorter than the receiver bottom wall front terminal edge. The receiver side wall back terminal edge length is longer than the receiver top wall back terminal edge but shorter than the receiver bottom wall back terminal edge. The receiver is generally as long as the channel. The bottom wall does not taper from the horizontal.

If legs are added to the device, they may be formed monolithically and integrally with the channel and receiver, or they may be slidably insertable into recesses formed in the channel.

The device also has two compression plates on either side, through which run stakes for anchoring the device. The compression plates can also be used to hold the bag onto a surface such as a tile or wooden or concrete floor, by taping the compression plates to the surface.

A clip is attached or formed on the sides of the channel. The clip holds a drawstring of a bag, securing the bag to the channel. The clip can take many forms, such as a jaw forced on to the channel by a spring, or two jaws forced together by a spring, or a carabiner.

In an alternate embodiment the channel and receiver are formed in two separate pieces, the rear of the receiver nests inside the channel interior, the receiver is pivotably connected to the channel by two pivot pins with each pivot pin running through one side of the channel and the adjacent side of the receiver.

DRAWINGS

These and other features, aspects and advantages of the embodiments of the apparatus and/or methods will become better understood with reference to the following description, appended claims and accompanying drawings where:

REFERENCE NUMERALS FOR DRAWINGS

Figure 1:
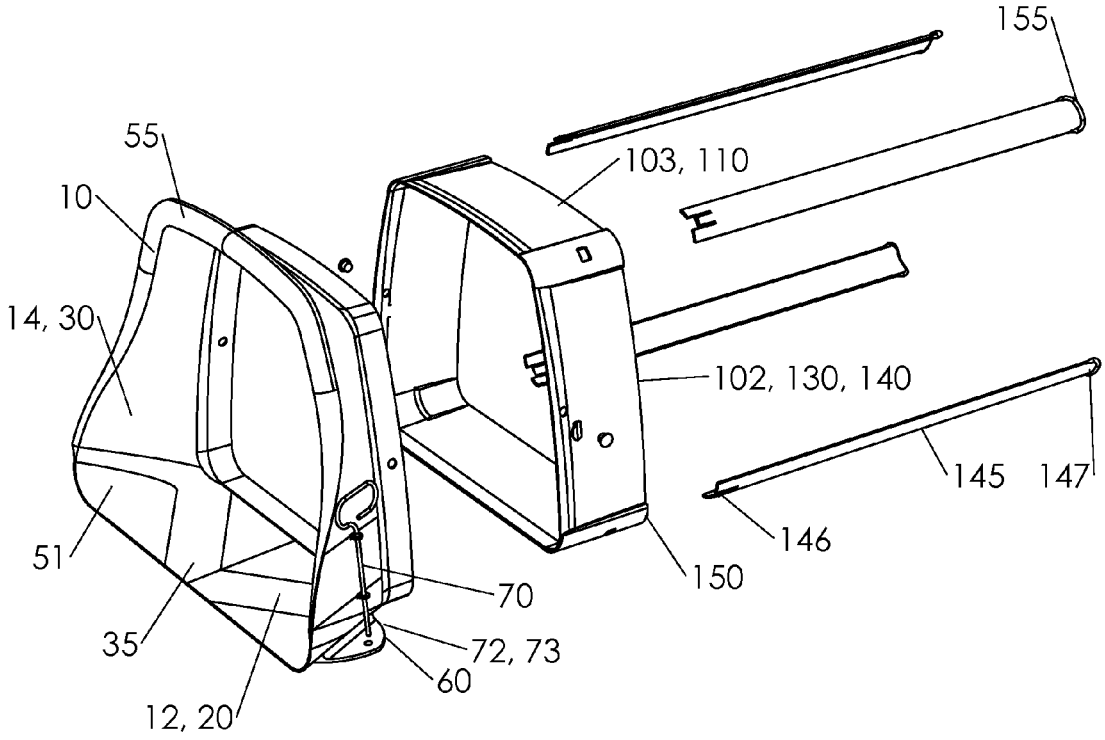
FIG. 1 shows an perspective view of an embodiment with legs.
Figure 2:
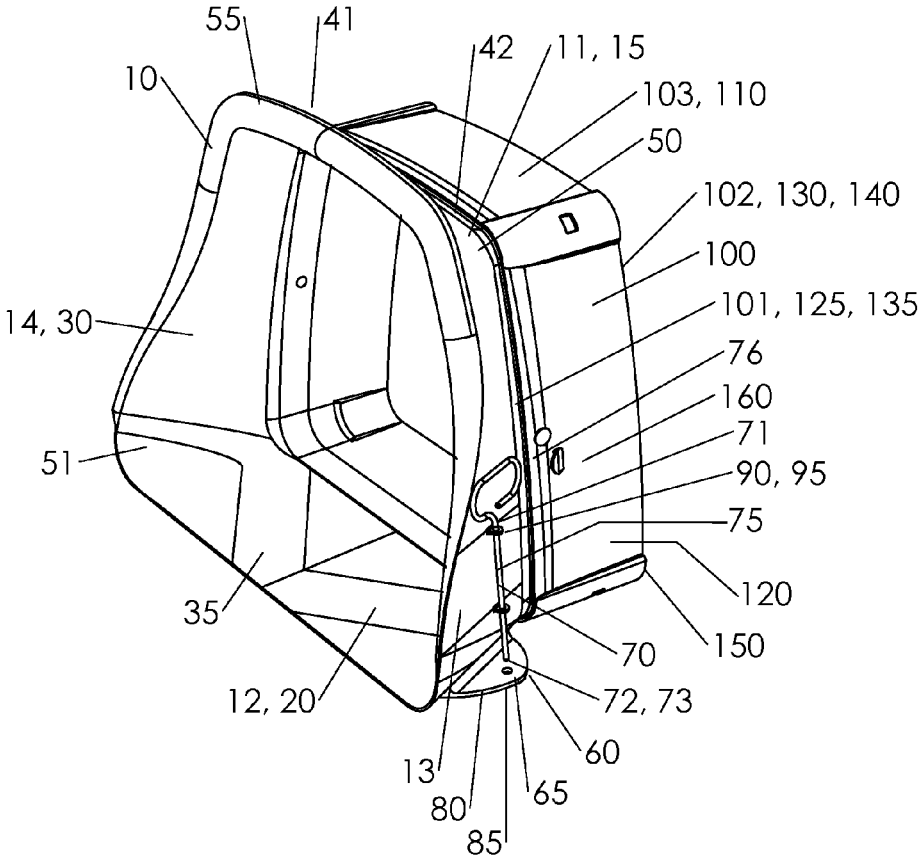
FIG. 2 shows a perspective view of an embodiment without legs.
Figure 3:
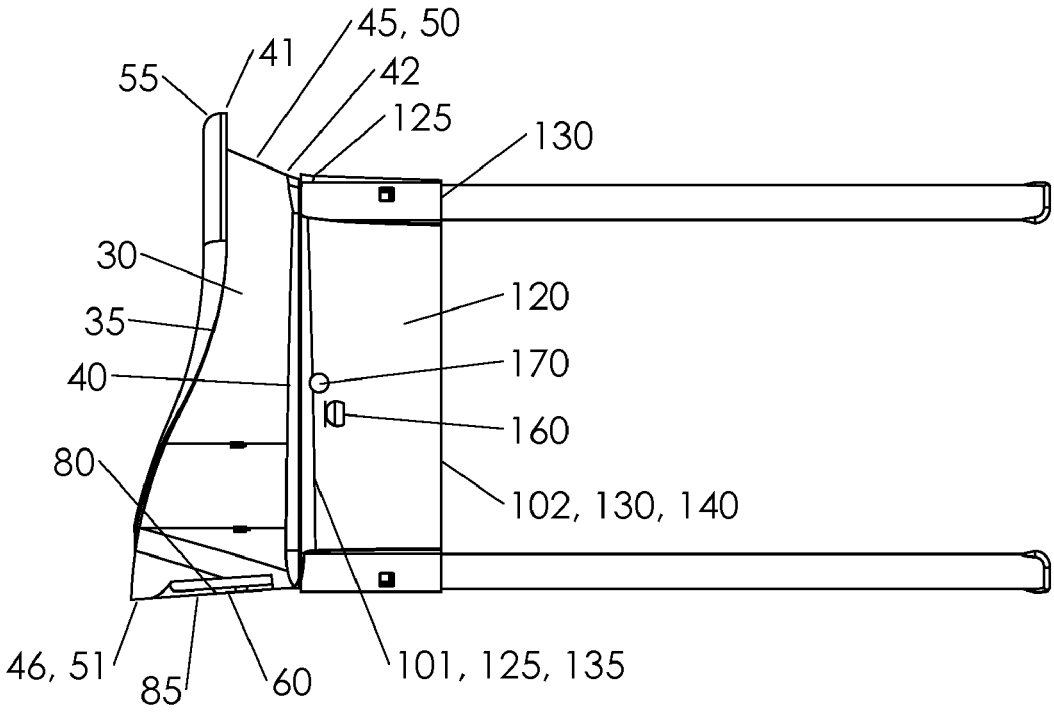
FIG. 3 shows a side view of an embodiment without legs.
Figure 4:
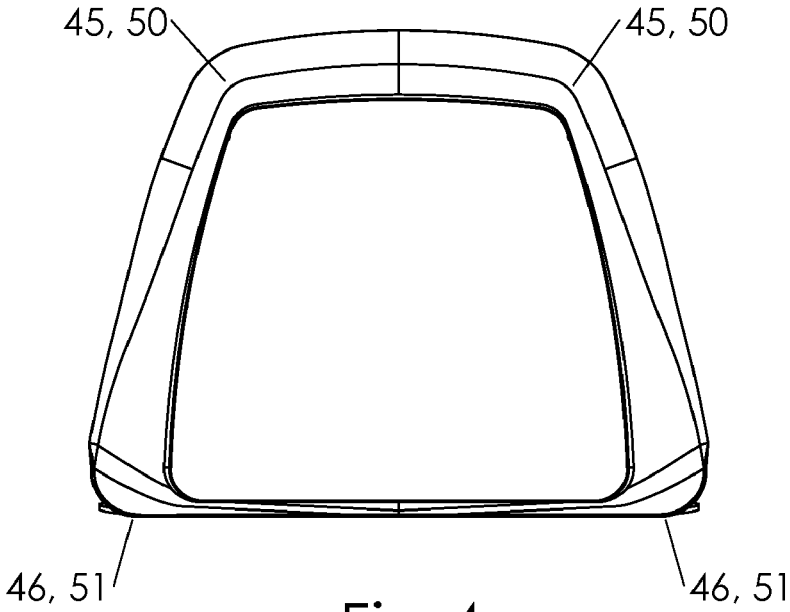
FIG. 4 shows a front view of an embodiment without legs.
Figure 5:
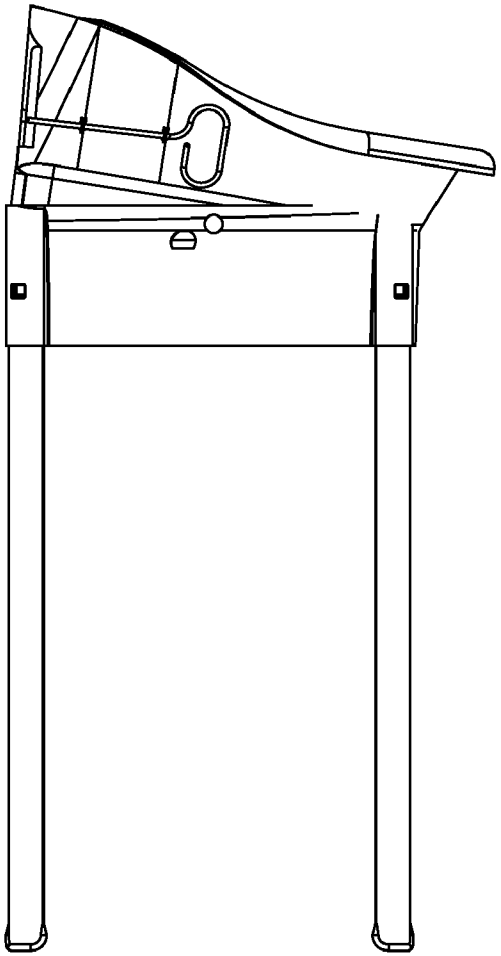
FIG. 5 shows a side view of an embodiment without legs, with the front pivoted upwards.
Figure 6:
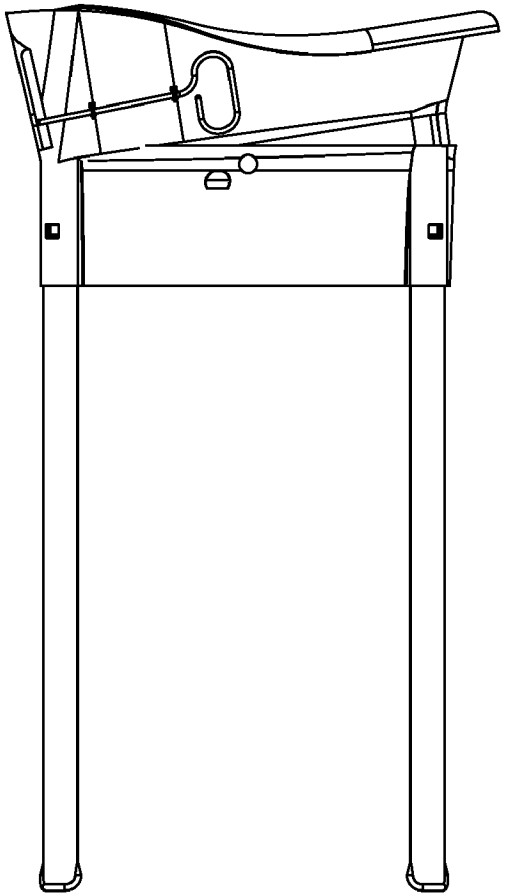
FIG. 6 shows a side view of an embodiment without legs, with the front pivoted downwards.

| | |
|---|---|
| 10 | receiver |
| 11 | receiver top |
| 12 | receiver bottom |
| 13 | receiver first side |
| 14 | receiver second side |
| 15 | receiver top wall |
| 20 | receiver bottom wall |
| 30 | receiver side wall |
| 35 | receiver front |
| 40 | receiver rear |
| 41 | receiver front terminal edge |
| 42 | receiver rear terminal edge |
| 45 | first lateral edge |
| 46 | second lateral edge |
| 50 | top wall lateral edge |
| 51 | bottom wall lateral edge |
| 55 | handle |
| 60 | compression plate |
| 65 | compression plate opening |
| 70 | tine |
| 71 | top of tine |
| 72 | bottom of tine |
| 73 | tip of tine |
| 75 | stake |
| 76 | stake handle |
| 80 | compression plate upper surface |
| 85 | compression plate lower surface |
| 90 | fastener |
| 95 | fastener opening |
| 100 | channel |
| 101 | channel front |
| 102 | channel rear |
| 103 | top |
| 104 | bottom |
| 110 | top wall |
| 115 | bottom wall |
| 120 | side wall |
| 125 | channel front terminal edge |
| 130 | channel rear terminal edge |
| 135 | front of channel |
| 140 | rear of channel |
| 145 | leg |
| 146 | first end of leg |
| 147 | second end of leg |
| 150 | recess |
| 155 | raised ring |
| 160 | clip |
| 170 | pivot pin |

DESCRIPTION

As shown in the Figures, the embodiments of the present invention comprises a device to facilitate filling a reusable bag, a conventional trash bag or a receptacle. The preferred embodiment of the device comprises:

A. i. a scoop-like semi-frusto-conical receiver 10 having a front 35 and a rear 40, a top 11 and a bottom 12, a first side 13 and a second side 14, a length, a longitudinal axis, a top wall 15, a bottom wall 20, two side watts 30, an interior and an exterior, one or more cross-sections as viewed perpendicularly to the longitudinal axis, each of the watts 15, 20, 30 having receiver front and rear terminal edges 41, 42 respectively comprising the front 35 and rear 40 of the receiver 10, the receiver front terminal edge 41 specifically comprising the bottom wall front terminal edge 41 and the top wall front terminal edge 41 and the two side wall front terminal edges 41, the receiver back terminal edge 42 specifically comprising the bottom wall back terminal edge 42 and the top wall back terminal edge 42 and the two side wall back terminal edges 42, each of the receiver front and rear terminal edges 41, 42 having receiver front and rear terminal edge lengths respectively, the receiver bottom wall front terminal edge length being longer than the receiver top wall front terminal edge, the receiver bottom wall back terminal edge length being longer than the receiver top wall back terminal edge, the receiver side wall front terminal edge length being longer than the receiver top wall front terminal edge but shorter than the receiver bottom wall front terminal edge, the receiver side wall back terminal edge length being longer than the receiver top wall back terminal edge but shorter than the receiver bottom wall back terminal edge, each of the walls 15, 20, 30 having a first lateral edge 45 and a second lateral edge 46, the first lateral edge 45 of each side wall 30 terminating at a top wall lateral edge 50 and the second lateral edge 46 of each side wall 30 terminating at a bottom wall lateral edge 51, the side wall lateral edges 45, 46 terminating in the top and bottom wall lateral edges 50, 51 to form a semi-frusto-conical shape, the receiver 10 tapering from a trapezoidal cross-section at its front 35 to a relatively smaller trapezoidal cross-section at its rear 40, the side walls 30 tapering towards one another as viewed from the receiver front 35 and towards the receiver rear 40, the top wall 15 tapering towards the bottom wall 20 as viewed from the receiver front 35 and towards the receiver rear 40, the two lateral edges 45, 46 of each of the side walls 30 respectively tapering towards one another as viewed from the receiver front 35 to the receiver rear 40, the two lateral edges 45, 46 of the top wall 15 tapering towards one another as viewed from the receiver front 35 to the receiver rear 40, the two lateral edges 45, 46 of the bottom wall 20 tapering towards one another as viewed from the receiver front 35 to the receiver rear 40, the bottom wall 20 flush with the ground, the receiver front 35 being an entry end of the device, the two side walls 30 and top wall 15 each having a turned-over receiver front terminal edge 41, the turned-over receiver front terminal edge 41 tapering continuously in a sigmoidal shape across the two side wall terminal edges 41 and top wall receiver front terminal edge 41, the turned-over receiver front terminal edge 41 on the top wall 15 functioning as a handle 55;

ii. at least two compression plates 60, with at least one plate 60 on each of the two sides 13, 14 of the front 35 bottom 12 of the receiver 10, the compression plates 60 monolithically extending from the receiver bottom wall 20 along a plane formed by the receiver bottom wall 20, the compression plates 60 each having a compression plate opening 65 adapted for receiving a tine 70 of a stake 75, the compression plates 60 each having an upper surface 80 and a lower surface 85, at least one fastener 90 attached on the receiver side wall 30 above and adjacent the upper surface 80 of each compression plate 60, the fastener 90 having a fastener opening 95 adapted for slidably receiving a tine 70 of a stake 75;

B. a channel 100 having a front 101 and a rear 102, a top 103 and a bottom 104, a length and a width and a height, a longitudinal axis 105, a top wall 110, a bottom wall 115, two side walls 120, an interior and an exterior, one or more cross-sections as viewed perpendicularly to the longitudinal axis, each of the walls 110, 115, 120 having channel front 125 and rear 130 terminal edges respectively comprising the front 135 and rear 140 of the channel 100, the length of the channel 100 longer than the length of the receiver 10, the length of the channel 100 approximately equal to the width of the channel 100, the height of the channel 100 longer than the length of the channel 100, the front 101 of the channel 100 monolithically extending from the rear 40 of the receiver 10 such that the channel 100 and receiver 10 are formed in one piece, the rear 140 of the channel 100 being an exit end of the device, the channel cross-sections having trapezoidal shapes; and C. at least two stakes 75, each stake 75 having at least one elongated tine 70, the tines 70 having top 71 and bottom 72 ends, the bottom end 72 having a tip 73, the top end 71 having a stake handle 76, the tines 70 of the stakes 75 slidably insertable through the compression plate openings 65 and through the fastener openings 95.

In an alternate embodiment the channel 100 and receiver 10 are formed in two separate pieces, the rear 40 of the receiver 10 nests inside the channel 100 interior, the receiver 10 is pivotably connected to the channel 100 by two pivot pins 170 with each pivot pin 170 running through one side wall 120 of the channel 100 and the adjacent side wall 120 of the receiver 10.

In an alternate embodiment, the device further comprises:

A. four legs 145, each leg 145 having a first end 146 and a second end 147 and a longitudinal axis and a perimeter;

B. four recesses 150 in the channel 100, the recesses 150 each aligned along the longitudinal axis for insertably receiving the first end 146 of each of said legs 145.

In an alternate embodiment, the second end 147 of the leg 145 has a raised ring 155 extending around the leg perimeter.

In an alternate embodiment, the device further comprises:

A. four legs 145, each leg 145 having a first end 146 and a second end 147 and a longitudinal axis 148 and a perimeter, the legs 145 monolithically extending from the channel 100.

In an alternate embodiment, the second end 147 of the leg 145 has a raised ring 155 extending around the leg perimeter.

In an alternate embodiment, the receiver 10, the channel 100 and the detachable legs 145 are made of plastic.

In an alternate embodiment, the device further comprises a clip 160 extending from each of the side walls 30 of the channel 100.

In an alternate embodiment, the clip 160 monolithically extends from each of the side walls 30 of the channel 100.

In an alternate embodiment, the handles 76 of the stakes 75 are each formed into an elliptical shape.

In an alternate embodiment, the stakes 75 are made of material selected from the group consisting of metal, steel, and aluminum.

In an alternate embodiment, the perimeters of the compression plates 60 have parabolic shapes.

In an alternate embodiment, the fastener 90 is an eyelet screw.

The embodiments of the invention further comprise a method for manufacturing a device to facilitate filling a reusable bag, a conventional trash bag or a receptacle, comprising providing:

A. a semi-frusto-conical receiver 10 comprising a scoop-like device having a front 35 and a rear 40, a top 11 and a bottom 12, a length, a longitudinal axis, a first side 13 and a second side 14, a top wall 15, a bottom wall 20, two side walls 30, an interior and an exterior, one or more cross-sections as viewed perpendicularly to the longitudinal axis, each of the walls 15, 20, 30 having receiver front and rear terminal edges 41, 42 respectively comprising the front 35 and rear 40 of the receiver 10, the receiver front terminal edge 41 specifically comprising the bottom wall front terminal edge 41 and the top wall front terminal edge 41 and the two side wall front terminal edges 41, the receiver back terminal edge 42 specifically comprising the bottom wall back terminal edge 42 and the top wall back terminal edge 42 and the two side wall back terminal edges 42, each of the receiver front and rear terminal edges 41, 42 having receiver front and rear terminal edge lengths respectively, the receiver bottom wall front terminal edge length being longer than the receiver top wall front terminal edge, the receiver bottom wall back terminal edge length being longer than the receiver top wall back terminal edge, the receiver side wall front terminal edge length being longer than the receiver top wall front terminal edge but shorter than the receiver bottom wall front terminal edge, the receiver side wall back terminal edge length being longer than the receiver top wall back terminal edge but shorter than the receiver bottom wall back terminal edge, each of the walls 15, 20, 30 having a first lateral edge 45 and a second lateral edge 46, the first lateral edge 45 of each side wall 30 terminating at a top wall lateral edge 50 and the second lateral edge 46 of each side wall 30 terminating at a bottom wall lateral edge 51, the side wall lateral edges 45, 46 terminating in the top and bottom wall lateral edges 50, 51 to form a semi-frusto-conical shape, the receiver 10 tapering from a trapezoidal cross-section at its front 35 to a relatively smaller trapezoidal cross-section at its rear 40, the side walls 30 tapering towards one another as viewed from the receiver front 35 and towards the receiver rear 40, the top wall 15 tapering towards the bottom wall 20 as viewed from the receiver front 35 and towards the receiver rear 40, the two lateral edges 45, 46 of each of the side walls 30 respectively tapering towards one another as viewed from the receiver front 35 to the receiver rear 40, the two lateral edges 45, 46 of the top wall 15 tapering towards one another as viewed from the receiver front 35 to the receiver rear 40, the two lateral edges 45, 46 of the bottom wall 20 tapering towards one another as viewed from the receiver front 35 to the receiver rear 40, the bottom wall 20 flush with the ground, the front 35 of the receiver 10 being an entry end of the device, the two side walls 30 and top wall 15 each having a turned-over receiver front terminal edge 41, the turned-over receiver front terminal edge 41 tapering continuously in a sigmoidal shape across the two side wall terminal edges 41 and top wall receiver front terminal edge 41, the turned-over receiver front terminal edge 41 on the top wall 15 functioning as a handle 55;

B. at least two compression plates 60, with at least one plate 60 on each of the two sides 13, 14 of the front 35 bottom 12 of the receiver 10, the compression plates 60 monolithically extending from the receiver bottom wall 20 along a plane formed by the receiver bottom wall 20, the compression plates 60 each having a compression plate opening 65 adapted for receiving a tine 70 of a stake 75, the compression plates 60 each having an upper surface 80 and a lower surface 85, at least one fastener 90 attached on the receiver side wall 30 above and adjacent the upper surface 80 of each compression plate 60, the fastener 90 having a fastener opening 95 adapted for slidably receiving a tine 70 of a stake 75;

C. a channel 100 having a front 101 and a rear 102, a top 103 and a bottom 104, a length and width and height, a longitudinal axis, a top wall 110, a bottom wall 115, two side walls 120, an interior and an exterior, one or more cross-sections as viewed perpendicularly to the longitudinal axis, each of the walls 110, 115, 120 having channel front and rear terminal edges 125, 130 respectively comprising the front 101 and rear 102 of the channel 100, the length of the channel 100 longer than the length of the receiver 10, the length of the channel 100 approximately equal to the width of the channel 100, the height of the channel 100 longer than the length of the channel 100, the front 101 of the channel 100 monolithically extending from the rear 40 of the receiver 10 such that the channel 100 and receiver 10 are formed in one piece, the rear 102 of the channel 100 being an exit end of the device, the channel cross-sections having trapezoidal shapes; and D. at least two stakes 75, each stake 75 having at least one elongated tine 70, the tines 70 having top 71 and bottom 72 ends, the bottom end 72 having a tip 73, the top end 71 having a stake handle 76, the tines 70 of the stakes 75 slidably insertable through the compression plate openings 65 and through the fastener openings 95.

In an alternate embodiment, the method further comprises providing four legs 145, each leg 145 having a first end 146 and a second end 147 and a longitudinal axis and a perimeter, providing four recesses 150 in the channel 100, the recesses 150 each aligned along the longitudinal axis for insertably receiving the first end 146 of each of said legs 145, and inserting the legs 145 into the recesses 150; and B. the inserting the-channel-into-the-bag step further comprises inserting the legs 145 into the bag.

In an alternate embodiment, the method further comprises providing legs 145 that monolithically extend from the channel 100.

In an alternate embodiment, the method further comprises providing a clip 160 extending from each of the side walls 120 of the channel 100.

In an alternate embodiment, the method further comprises providing a clip 160 that monolithically extends from each of the side walls 120 of the channel 100.

Some advantages of the embodiments of the apparatus were previously enumerated in the Summary section. Every advantageous feature does not need to be incorporated into every embodiment of the apparatus and/or methods.

Although these versions of the invention have been described in considerable detail, other versions are possible. Therefore, the spirit and scope of the appended claims should not be limited to the description of the versions contained therein.

I claim:

1. A device to facilitate filling a reusable bag, a conventional trash bag or a receptacle, comprising:

A.

i. a scoop-like semi-frusto-conical receiver having a front and a rear, a top and a bottom, a length, a longitudinal axis, a first side and a second side, a top wall, a bottom wall, two side walls, an interior and an exterior, one or more cross-sections as viewed perpendicularly to the longitudinal axis, each of the walls having receiver front and rear terminal edges respectively comprising the front and rear of the receiver, the receiver front terminal edge specifically comprising the bottom wall front terminal edge and the top wall front terminal edge and the two side wall front terminal edges, the receiver back terminal edge specifically comprising the bottom wall back terminal edge and the top wall back terminal edge and the two side wall back terminal edges, each of the receiver front and rear terminal edges having receiver front and rear terminal edge lengths respectively, the receiver bottom wall front terminal edge length being longer than the receiver top wall front terminal edge, the receiver bottom wall back terminal edge length being longer than the receiver top wall back terminal edge, the receiver side wall front terminal edge length being longer than the receiver top wall front terminal edge but shorter than the receiver bottom wall front terminal edge, the receiver side wall back terminal edge length being longer than the receiver top wall back terminal edge but shorter than the receiver bottom wall back terminal edge, each of the walls having a first lateral edge and a second lateral edge, the first lateral edge of each side wall terminating at a top wall lateral edge and the second lateral edge of each side wall terminating at a bottom wall lateral edge, the side wall lateral edges terminating in the top and bottom wall lateral edges to form a semi-frusto-conical shape, the receiver tapering from a trapezoidal cross-section at its front to a relatively smaller trapezoidal cross-section at its rear, the side walls tapering towards one another as viewed from the receiver front and towards the receiver rear, the top wall tapering towards the bottom wall as viewed from the receiver front and towards the receiver rear, the two lateral edges of each of the side walk respectively tapering towards one another as viewed from the receiver front to the receiver rear, the two lateral edges of the top wall tapering towards one another as viewed from the receiver front to the receiver rear, the two lateral edges of the bottom wall tapering towards one another as viewed from the receiver front to the receiver rear, the bottom wall flush with the ground, the front of the receiver being an entry end of the device, the two side walls and top wall each having a turned-over front receiver terminal edge, the turned-over receiver front terminal edge tapering continuously in a sigmoidal shape across the two side wall terminal edges and top wall receiver front terminal edge, the turned-over receiver front terminal edge on the top wall functioning as a handle;

ii. at least two compression plates, with at least one plate on each of the two sides of the front bottom of the receiver, the compression plates monolithically extending from the receiver bottom wall along a plane formed by the receiver bottom wall, the compression plates each having a compression plate opening adapted for receiving a tine of a stake, the compression plates each having an upper surface and a lower surface, at least one fastener attached on the receiver side wall above and adjacent the upper surface of each compression plate, the fastener having a fastener opening adapted for slidably receiving a tine of a stake;

B. a channel having a front and a rear, a top and a bottom, a length and a width and a height, a longitudinal axis, a top wall, a bottom wall, two side walls, an interior and an exterior, one or more cross-sections as viewed perpendicularly to the longitudinal axis, each of the walls having channel front and rear terminal edges respectively comprising the front and rear of the channel, the length of the channel longer than the the length of the receiver, the length of the channel approximately equal to the width of the channel, the height of the channel longer than the length of the channel, the front of the channel monolithically extending from the rear of the receiver such that the channel and receiver are formed in one piece, the rear of the channel being an exit end of the device, the channel cross-sections having trapezoidal shapes; and C. at least two stakes, each stake having at least one elongated tine for puncturing soil and for facilitating pushing the stake into soil, the tines having top and bottom ends, the bottom end having a tip, the top end having a handle, the tines of the stakes slidably insertable through the compression plate openings and through the fastener openings.

2. The device of claim 1, further comprising:

A. four legs, each leg having a first end and a second end and a longitudinal axis and a perimeter;

B. four recesses in the channel, the recesses each aligned along the longitudinal axis for insertably receiving the first end of each of said legs.

3. The device of claim 2, the second end having a raised ring extending around the leg perimeter.

4. The device of claim 1, further comprising:

A. four legs, each leg having a first end and a second end and a longitudinal axis and a perimeter, the legs monolithically extending from the channel.

5. The device of claim 4, the second end having a raised ring extending around the leg perimeter.

6. The device of claim 1, wherein the receiver, the channel and the detachable legs are made of plastic.

7. The device of claim 1, further comprising a clip extending from each of the side walls of the channel.

8. The device of claim 7, wherein each clip is screwed into a side wall.

9. The device of claim 7, wherein the clip monolithically extends from each of the side walls of the channel.

10. The device of claim 1, wherein the handles of the stakes are each formed into an elliptical shape.

11. The device of claim 1, wherein the stakes are made of material selected from the group consisting of metal, steel, and aluminum.

12. The device of claim 1, wherein the perimeters of the compression plates have parabolic shapes.

13. The device of claim 1, wherein the fastener is an eyelet screw.

14. The device of claim 1, wherein the channel has dimensions of 12 inches long, 14 inches high and 12 inches wide.

15. The device of claim 1, wherein the channel and receiver are formed in two separate pieces, the rear of the receiver nests inside the channel interior, the receiver is pivotably connected to the channel by two pivot pins with each pivot pin running through one side of the channel and the adjacent side of the receiver.

16. A method for manufacturing a device to facilitate filling a reusable bag, a conventional trash bag or a receptacle, comprising:

A. providing a scoop-like semi-frusto-conical receiver having a front and a rear, a top and a bottom, a length, a longitudinal axis, a first side and a second side, a top wall, a bottom wall, two side walls, an interior and an exterior, one or more cross-sections as viewed perpendicularly to the longitudinal axis, each of the walls having receiver front and rear terminal edges respectively comprising the front and rear of the receiver, the receiver front terminal edge specifically comprising the bottom wall front terminal edge and the top wall front terminal edge and the two side wall front terminal edges, the receiver back terminal edge specifically comprising the bottom wall back terminal edge and the top wall back terminal edge and the two side wall back terminal edges, each of the receiver front and rear terminal edges having receiver front and rear terminal edge lengths respectively, the receiver bottom wall front terminal edge length being longer than the receiver top wall front terminal edge, the receiver bottom wall back terminal edge length being longer than the receiver top wall back terminal edge, the receiver side wall front terminal edge length being longer than the receiver top wall front terminal edge but shorter than the receiver bottom wall front terminal edge, the receiver side wall back terminal edge length being longer than the receiver top wall back terminal edge but shorter than the receiver bottom wall back terminal edge, each of the walls having a first lateral edge and a second lateral edge, the first lateral edge of each side wall terminating at a top wall lateral edge and the second lateral edge of each side wall terminating at a bottom wall lateral edge, the side wall lateral edges terminating in the top and bottom wall lateral edges to form a semi-frusto-conical shape, the receiver tapering from a trapezoidal cross-section at its front to a relatively smaller trapezoidal cross-section at its rear, the side walls tapering towards one another as viewed from the receiver front and towards the receiver rear, the top wall tapering towards the bottom wall as viewed from the receiver front and towards the receiver rear, the two lateral edges of each of the side walls respectively tapering towards one another as viewed from the receiver front to the receiver rear, the two lateral edges of the top wall tapering towards one another as viewed from the receiver front to the receiver rear, the two lateral edges of the bottom wall tapering towards one another as viewed from the receiver front to the receiver rear, the bottom wall flush with the ground, the front of the receiver being an entry end of the device, the receiver front terminal edges of the two side walls and top wall each having a turned-over receiver front terminal edge, the turned-over receiver front terminal edge tapering continuously in a sigmoidal shape across the two side wall terminal edges and top wall receiver front terminal edge, the turned-over receiver front terminal edge on the top wall functioning as a handle;

B. providing at least two compression plates, with at least one plate on each of the two sides of the front bottom of the receiver, the compression plates monolithically extending from the receiver bottom wall along a plane formed by the receiver bottom wall, the compression plates each having a compression plate opening adapted for receiving a tine of a stake, the compression plates each having an upper surface and a lower surface, at least one fastener attached on the receiver side wall above and adjacent the upper surface of each compression plate, the fastener having a fastener opening adapted for slidably receiving a tine of a stake;

C. providing a channel having a front and a rear, a top and a bottom, a length and a width and a height, a longitudinal axis, a top wall, a bottom wall, two side walls, an interior and an exterior, one or more cross-sections as viewed perpendicularly to the longitudinal axis, each of the walls having channel front and rear terminal edges respectively comprising the front and rear of the channel, the length of the channel longer than the the length of the receiver, the length of the channel approximately equal to the width of the channel, the height of the channel longer than the length of the channel, the front of the channel monolithically extending from the rear of the receiver such that the channel and receiver are formed in one piece, the rear of the channel being an exit end of the device, the channel cross-sections having trapezoidal shapes; and D. providing at least two stakes, each stake having at least one elongated tine for puncturing soil and for facilitating pushing the stake into soil, the tines having top and bottom ends, the bottom end having a tip, the top end having a handle, the tines of the stakes slidably insertable through the compression plate openings and through the fastener openings.

17. The method of claim 16, further comprising providing four legs, each leg having a first end and a second end and a longitudinal axis and a perimeter, providing four recesses in the channel, the recesses each aligned along the longitudinal axis for insertably receiving the first end of each of said legs, and inserting the legs into the recesses; and B. the inserting the-channel-into-the-bag step further comprises inserting the legs into the bag.

18. The method of claim 17, further comprising providing legs that monolithically extend from the channel.

19. The method of claim 16, further comprising providing a clip extending from each of the side walk of the channel.

20. The method of claim 19, further comprising providing a clip that is screwed into the side wall of the channel.

* * * * *